US005622126A

United States Patent [19]

Card et al.

[11] Patent Number: 5,622,126

[45] Date of Patent: Apr. 22, 1997

[54] TUFTING MACHINE YARN FEED MECHANISM

[75] Inventors: Roy T. Card, Chattanooga, Tenn.; Wilton Hall, Fort Oglethorpe, Ga.

[73] Assignee: Card-Monroe Corporation, Chattanooga, Tenn.

[21] Appl. No.: 376,345

[22] Filed: Jan. 23, 1995

[51] Int. Cl.[6] ..... D05C 15/18

[52] U.S. Cl. ..... 112/80.73

[58] Field of Search ..... 139/97; 112/80.73, 112/80.7, 80.01, 302

[56] References Cited

U.S. PATENT DOCUMENTS

| | | | |
|---|---|---|---|
| 2,880,684 | 4/1959 | Masland, II | 112/80.73 |
| 3,134,529 | 5/1964 | Beasley | 112/80.73 X |
| 4,411,207 | 10/1983 | Brock et al. | 112/80.73 |
| 4,856,441 | 8/1989 | Kurata | 112/80.73 |
| 5,182,997 | 2/1993 | Bardsley | 112/80.73 |

*Primary Examiner*—Paul C. Lewis
*Attorney, Agent, or Firm*—Isaf, Vaughan & Kerr

[57] ABSTRACT

A yarn feed mechanism for a tufting machine includes yarn feed rolls disposed along parallel axes transversely adjacent to the parallel paths of travel of yarns from yarn sources to the needles. A yarn control assembly surrounds each roll, each yarn control assembly having a pair of opposed, concentrically mounted, indexing plates at opposite ends of each roll. Each pair of indexing plates carries a plurality of individually removable cimcumferentially spaced, yarn control rods, the plates being manually rotatable about the axis of the roll, independently of the rotation of the roll. By collecting intermediate increments of selected yarns on one of the rods, then rotating the indexing plates, with the rod installed to selected positions, the rod is moved in an orbital path for applying the yarn increments to portions of the periphery of the roll, such that the roll feeds controlled successive amounts of applied yarns toward the needles.

16 Claims, 5 Drawing Sheets

TUFTING MACHINE YARN FEED MECHANISM

FIELD OF INVENTION

This invention relates to a tufting machine and is more particularly concerned with a tufting machine improved yarn feed mechanism and to the process of using such mechanism.

BACKGROUND OF THE INVENTION

In the past, roll type pattern attachments or yarn feed mechanisms have been extensively used with tufting machines for feeding the yarns to the needles of tufting machines according to prescribed patterns. Such a roll type yarn feed mechanism controls the rate at which prescribed yarns are fed to selected needles in the tufting zone of the tufting machine. This feed, in turn, controls the pile height, usually by causing the yarns to be robbed from the previously sewn loops in the backing material.

In the prior art it has usually been necessary, when a yarn breaks or when different yarns are to be tied to different needles, to re-wrap such yarn or yarns around a roller or rollers and re-thread the needles. Threading or rethreading of a tufting machine needle is quite laborious since usually each yarn must be wrapped around the roller or spindle, as the case may be, and threaded or rethreaded thereafter, each time there is to be a change of sequence of the yarns across the width of the machine.

The present invention enables intermediate portions of the yarns to be selected, after threading, and moved against and partially around any selected feed roller, thereby eliminating the necessity of wrapping the yarns around the roller or spindle and rethreading the needles, thereafter. This reduces materially the time required in making a change in sequence of yarns across the width of the tufting machine and eliminates the need for cutting each end of the yarn for the purpose of changing from one yarn feed axis (yarn feed roll) to another.

SUMMARY OF THE INVENTION

Briefly described, the present invention includes a conventional tufting machine with its reciprocating needles carried by one or more needle bars and reciprocated for inserting the needles through a backing material, the tufting machine having a plurality of parallel yarn feed rolls or rollers disposed adjacent to the path of travel of the yarns. Each roll has a plurality of circumferentially spaced, parallel axially extending, orbitally movable yarn control rods, carried at their ends, by opposed pairs of radially extending indexing plates or discs, these plates or discs being concentrically mounted, with respect to their associated roll, for permitting the control rods incrementally to be indexed about the roll to selected positions for applying the yarns to a portion of the periphery of an associated roll.

Each rod has, at one end, a spring loaded telescoping detent plug, the distal end of which protrudes from the end of the rod for being received in pairs of opposed sockets in the opposed indexing plates, so that a selected transverse rod can readily be installed and removed from an opposed pair of sockets. Preferably, these rods are arranged in circumferentially spaced parallel transverse relationship, about 90° from each other for circumscribing about 270° of each roll, the rods being spaced away from the periphery of their associated roll, the rods serving a double function of holding intermediate portions of the yarns out of engagement with a roll while applying other intermediate portions of the selected yarns to the roll for partially circumscribing and engaging the sandpaper peripheral surface of that roll.

The yarn feed mechanism of the present invention includes a plurality of rolls, each individually driven by a servomotor. The servomotors, in turn, are controlled by a computer so as to be synchronized with the reciprocation of the needles and the feed of the backing material.

Yieldable detents on the rods enable the indexing plates to be readily rotated to selected angular positions where the selected yarns are partially wrapped around the selected roll.

Accordingly,it is an object of the present invention to provide a quick change yarn teed mechanism for a tufting machine which will permit the applying of intermediate portions of selected yarns to selected feed rolls, without the necessity of rethreading or manually wrapping the yarns around the rolls.

Another objection of the present invention is to provide a quick change yarn feed mechanism for a tufting machine which is inexpensive to manufacture, durable in structure and efficient in operation.

Another object of the present invention is to provide a quick change yarn feed mechanism for a tufting machine wherein an operator can readily change the sequence of yarns across the width of the tufting machine, without the necessity of cutting each yarn for the purpose of changing to a different yarn feed axis (rolls) or rethreading the yarns.

Another object of the present invention is to provide a quick change yarn feed mechanism for a tufting machine which eliminates the necessity of manually wrapping the yarn around a roller or spindle in order to provide for the feed of the yarn by that roll.

Another object of the present invention is to provide a yarn feed mechanism for a tufting machine which can be readily and easily accessed by operating personnel while they are standing, upright, on a floor, on which the machine is mounted, and without the necessity of kneeling or stooping.

Another object of the present invention is to provide a mechanism which will enable yarns to be fed by yarn feed rolls wherein the yarns only contact a portion of the periphery of the feed rolls.

Another object of the present invention is to provide a tufting machine having a quick change yarn feed mechanism wherein each axis (roll) is driven by electrical signals which can readily and easily change for dictating the length of the feed of successive increments of yarns.

Another object of the present invention is to provide a yarn feed mechanism which provides an inexpensive and efficient way of pulling yarns from a beam or creal for feeding the same to a tufting zone.

Another object of the present invention is to provide a yarn feed mechanism which enables selected yarns to be easily placed in contact with one prescribed feed roller for being fed at a prescribed rate thereby and can be readily and easily changed to contacting another feed roll which is capable of feeding the yarn at a different rate.

Another object of the present invention is to provide a process by which yarns may be brought into contact with feed rolls of a tufting machine and can be easily changed from one roll to another in a facile manner.

Another object of the present invention is to provide an apparatus and process of feeding yarns to a tufting zone in which the pattern of feeding the yarns can be easily changed.

Other objects, features and advantages of the present invention will become apparent from the following description, considered in conjunction with the accompanying drawings wherein like character references designate corresponding parts throughout the several views.

DETAILED DESCRIPTION

Figure 1:
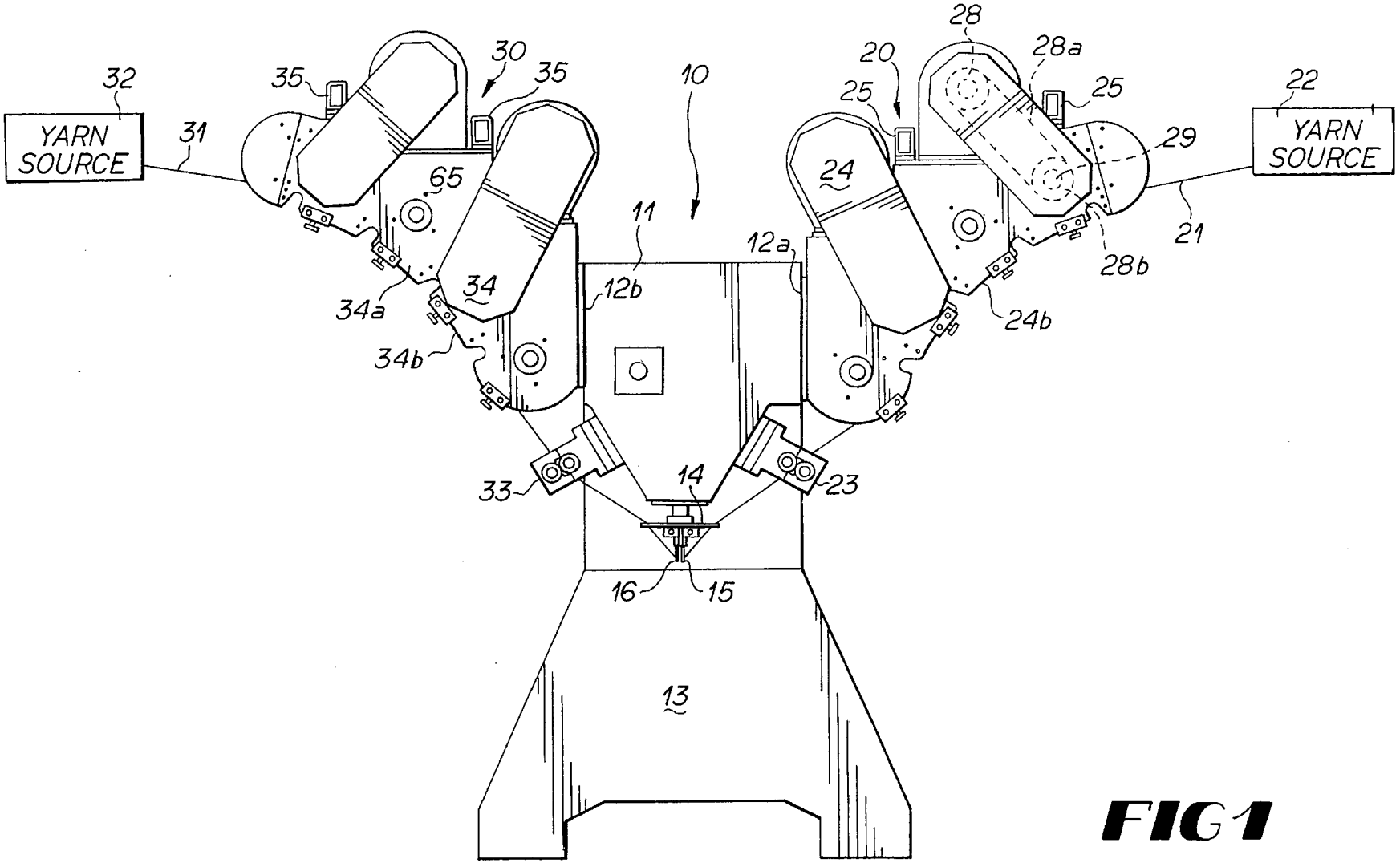
FIG. 1 is a schematic side elevational view of a conventional tufting machine having incorporated therewith front and rear, quick change, yarn feed mechanisms, constructed in accordance with the present invention.

Referring now in detail to the embodiment chosen for the purpose of illustrating the present invention, numeral 10 denotes generally a conventional tufting machine having a head 11 with front and rear opposed, vertically disposed, side plates 12*a* and 12*b*, the head 11 being mounted on a base 13. This conventional tufting machine 10 also includes a reciprocatable needle bar 14 which carries a front row of needles 15 and a rear row of needles 16, the needle bar 14 being laterally shiftable with respect to the tufting machine 10.

A front yarn feed mechanism 20 includes two or more transversely spaced, vertically disposed, opposed, support brackets 24 which extend upwardly and forwardly from plate 12*a* of head 11. Spaced parallel, transverse beams or cross bars 25 join the upper portions of brackets 24 for reinforcement.

Mounted to the front plate 12*a* is the front yarn feed mechanism or yarn pattern attachment, denoted generally by the numeral 20, which feeds a plurality of front yarns 21, in an inwardly and downwardly direction, from a front yarn source 22 via the mechanism 20 and a yarn puller 23 to the needles 15.

In like fashion, the rear plate 12*b* supports a pattern attachment or rear yarn feed mechanism 30 which is complimentary to yarn feed mechanism 20 except that it is mounted on the rear plate 12*b*, as seen best in FIG. 1. The rear yarn feed mechanism 30 includes two or more transversely spaced, vertically disposed, opposed, support brackets 34 which extend upwardly and rearwardly from plate 12*b* of head 11. The transverse beams 35 join the upper edges of brackets 34 to form a frame assembly. This frame assembly, including brackets 34 and beams 35, supports the remainder of the structure of the pattern attachment or yarn feed mechanism 30. Since the front yarn feed mechanism 20 (also known as the front pattern attachment) is complimentary to the rear yarn feed mechanism or pattern attachment 30, the remainder of this description will be devoted primarily to pattern attachment or yarn feed mechanism 30, it being understood that similar components are contained in yarn feed mechanism 20.

Figure 2:
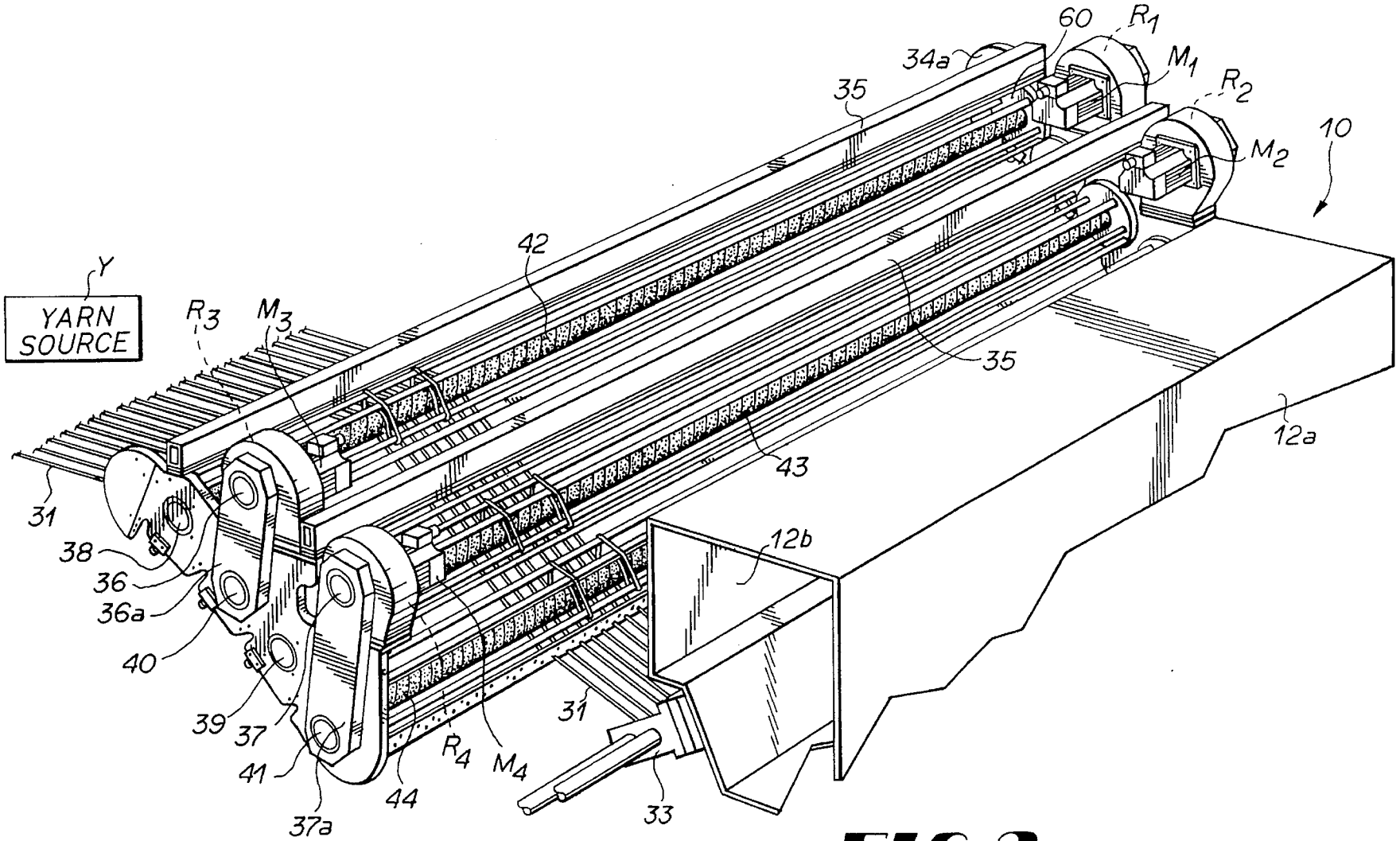
FIG. 2 is a fragmentary perspective view of a portion of the tufting machine shown in FIG. 1.
Figure 9:
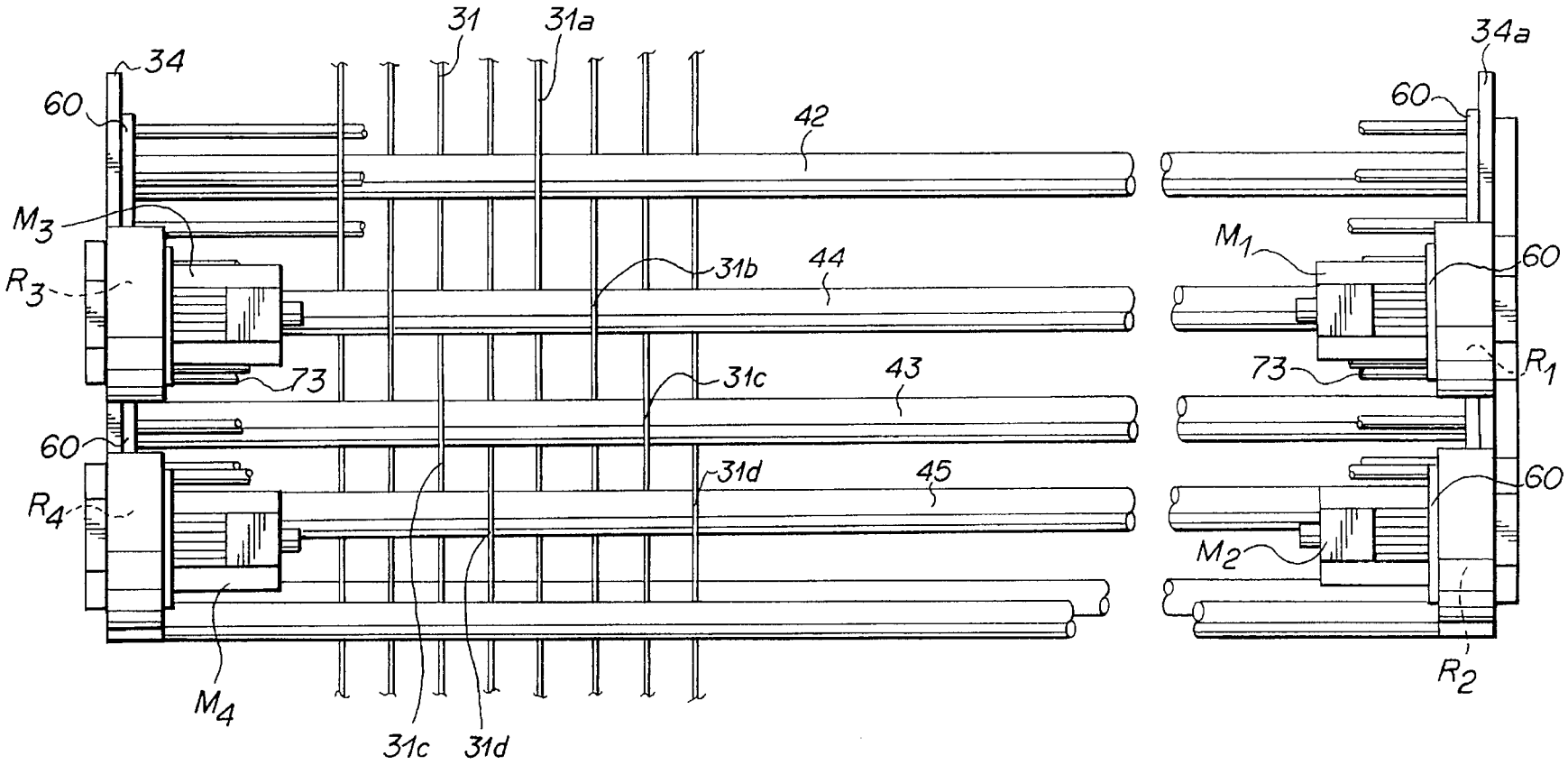
FIG. 9 is a fragmentary plan view of a portion of the yarn feed assembly shown in FIG. 2.

The pattern attachment or yarn feed mechanism 30 has four servomotors M1, M2, M3 and M4, seen best in FIGS. 2, and 9 respectively driving, through reducers R1, R2, R3 and R4, the drive shafts, such as shafts 36 and 37 in FIG. 2, in turn drive roll shafts 38 39, 40 and 41, through drive trains contained in covers, such as covers 36*a* and 37*a*. Each drive train includes a sheave, such as sheave 28, driving an endless timing belt, such as belt 28*a*, which drives a wheel or sheave, such as sheave 28*b*, on a roll shaft, such as roll shaft 29, all seen in FIG. 1. The, the four servomotors M1, M2, M3, and M4 respectively control and drive for yarn feed rolls 42, 43, 44, and 45, seen best in FIG. 9. Each of the yarn feed rolls 42, 43, 44, 45 is provided with a helically wound sandpaper periphery, such as periphery 42*a* seen in FIG. 3. Below and on opposite sides of each yarn feed roll, such as roll 42, are a pair of angle iron yarn guides 55 and 56 which run parallel to the axes of the yarn feed rolls. These yarn guides 55 and 56 are provided. with a plurality of transversely aligned staggered holes 55*a* and 56*a* through which the respective yarns 31 pass. The ends of the yarn guides 55 and 56 are secured to and supported by the inner surfaces of the brackets 34 and 34*a*. Adjacent to the apexes of the yarn guides 55, 56 are yarn slide bars 57 and 58, seen in FIG. 3.

Each roll, such as roll 42, terminates inwardly of the inner surfaces of the brackets 34, 34*a*, so as to provide spaces sufficient to respectively receive the opposed pair of annular radially extending, concentrically disposed, bar indexing plates or pattern discs 60 and 61, shown in FIGS, 5 to 8. Each indexing plate 60 or 61 is rotatably journaled on its bracket 34 or 34*a* by means of a flanged cylindrical sleeve 62 mounted by its flange (not shown) flat against the inner surface of bracket 34 or 34*a*, this flange being held in place by bolts 65, seen in FIG. 1. Each sleeve 62, also receives a bearing, such as bearing 64, shown in FIG. 3, for journaling the ends of the roll shaft, such as shaft 38.

As seen best in FIG. 3, each bracket, such as bracket 34 is provided with a plurality of spaced detent members 68 respectively below the indexing plates 60, 61, each detent member including a channel shaped base 68*a* bolted, by bolts 68*b*, in place along the lower edge of the bracket 34 or 34*a*. A locking mechanism 70 is threadedly received in base 68*a* so that its distal end portion is adapted to be aligned selectively with any one of a plurality of spaced peripheral notches or recesses 72 in the periphery of each of the indexing plates 60 or 61. These notches or recesses 72 are circumferentially spaced at 90° intervals along the periphery of each indexing plate 60 or 61 so that a yieldable plunger 70*b* of the cooperating locking mechanism 70 can protrude into a selected notch 72, when that notch 72 is aligned with locking mechanism 70 as best seen in FIGS. 5 to 8.

The locking mechanism 70 has an external knurled head 70*a* at its proximal end and carries the spring loaded plunger 70*b* in its distal end. Plunger 70*b* has a rounded tip, suitable for being received in the recess 72. When the locking mechanism 70 is released, by retracting the of head 70*a*, the plunger 70*b* is rendered yieldable for permitting ready manual rotation of the indexing plate 60. The plunger 70*b*, however, is normally resiliently urged into one recess 72 when the indexing plate 60 aligns the recess 72; however, it will yield to manual rotational force applied to the indexing plate 60 or 61, only when the locking mechanism 70 is in a released condition. Once the locking mechanism 70 is tightened, it locks the indexing plate 60 or 61 in a selected angular position.

For maintaining the opposed pairs of indexing plates 60, 61 in axial alignment with each other, for simultaneous rotation, each pair of opposed indexing plates 60, 61 is provided with an alignment bar 73, seen in FIGS. 5 to 8, the ends of which are respectively received in opposed supports 75. Each alignment bar 73 is preferably an angle iron which is secured at its ends to the supports, such as support 75, which, in turn, are bolted by bolts 76 to the associated indexing plate 60 or 61.

Figures 3, 4:
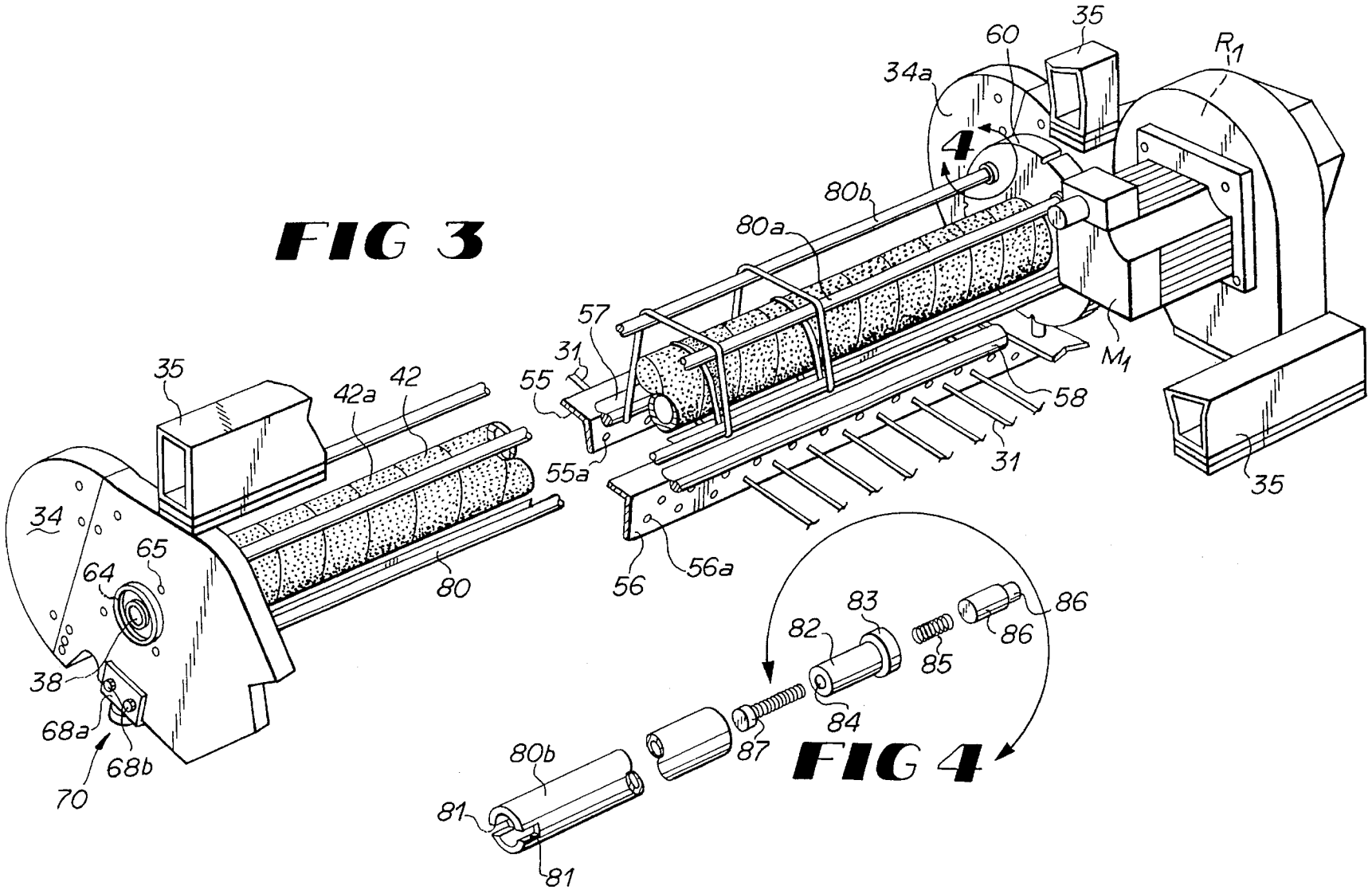
FIG. 3 is a fragmentary plan view of a pan of that portion of the tufting machine disclosed in FIG. 2.
FIG. 4 is an enlarged exploded perspective view in the region of numeral 4 in FIG. 3 showing an end portion of one of the rods of the yarn indexing assembly.
Figure 5:
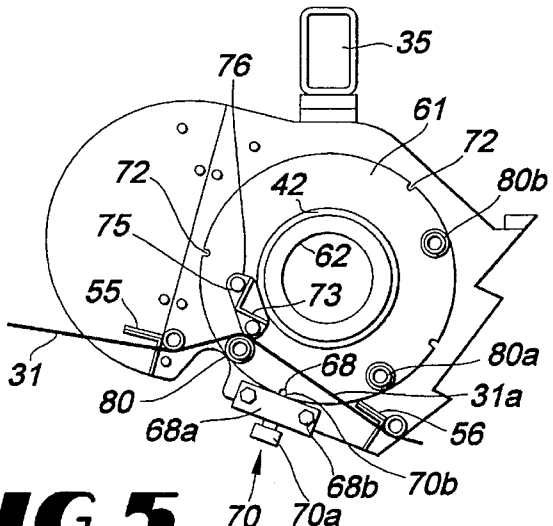
FIG. 5 is a vertical sectional view of a portion of the structure shown in FIG. 2 and showing a disc and rods of an indexing assembly in the initial position.

Extending between each opposed pairs of indexing plates 60, 61 and spaced about 90° from each other, are a plurality, preferably three straight, polished, steel, yarn control rods 80, 80*a* and 80*b*, best seen in FIGS. 4 and 5. Control rod 80 functions as a yarn applying member. Control rod 80, 80*a* and 80*b* are identical, each rod, such as rod 80*b* in FIG. 4, being a hollow tubular cylindrical member, the proximal end of which is provided with a pair of transverse notches 81 and the distal end of which is provided with a yieldable plug assembly. This plug assembly includes a lug 82 having a cylindrical body received in the distal end of rod 80*b* and an enlarged collar 83 at one of its ends. Lug 82 has an internal axial bore 84, and is counterbored so as to provide an internal arresting flange (not shown) at collar 83. The bore 84 receives an axially movable plunger 86 having a protruding tip 86*a*, the plunger 86 being urged to a seated position against the internal flange of collar 83 by a coiled compression spring 85, which, in turn, is confined in a compressed condition in bore 84 by the end of machine screw 87, threadedly received in the bore 84. The lug 82 is press fitted into the distal end of bar 80 so that the tip 86*a* of plunger 86 protrudes outwardly from the collar 83 of lug 82. The tip 86*a* thus forms a yieldable, spring loaded, detent for removably retaining the rod 80*b* in place between the two indexing plates 60, 61.

For receiving the ends of the yarn control rods 80, 80*a*, 80*b*, the indexing plates 60, 61 are provided with 90° spaced, opposed pairs of holes or sockets (not visible in the figures), the sockets of plate 60 each having a transverse pin (not shown) fixed in and extending across socket for preventing the rotation of the rod 80 when the slots 81 of any of rods 80, 80*a*, 80*b* are received over that pin. This prevents the rod 80, 80*a*, 80*b*, from rotating about its own axis.

The spring plunger 86, when depressed into its rod 80, 80*a* or 80*b*, fits into corresponding socket of the indexing plate 61 so as to yieldably hold the distal end of the rod 80, 80*a*, 80*b* in its prescribed socket 89*a*. When, however, the rod 80 is urged in a direction toward its plunger 86 to the right in FIG. 3, plunger 86 will be urged into the lug 82 sufficiently so that the proximel end of the rod may be removed from its socket 89. Thus, the rods 80, 80*a*, 80*b* are readily removable from between the two indexing plates 60, 61, but are normally retained in positions parallel to each other, parallel to the axis of its associated roll 42, 43, 44 or 45, spaced from the periphery of such roll and transversely to and spaced from the yarns 31.

As best seen in FIG. 3, the yarn guides 55 and 56 for each roll, such as roll 42, are sufficiently below the roll that when the machine is threaded, the yarns 31 pass from the yarn source 32 through successive opposed pairs of aligned holes, such as holes 55*a*, 56*a* and thence, to the next adjacent pair of yarn guides for the next adjacent roll, etc., all of the yarns 31 then passing in parallel, downward and inward extending paths so that the intermediate portions of the yarns, which pass between the pairs of yarn guides, such as guides 55 and 56, which are associated with a particular roll 42, 43, 44, 45, are spaced outwardly and downwardly from their respective rolls 42, 43, 45 and such yarn increments are thus accessible by the operator, as he stands on a floor F and adjacent to the feed mechanism 20 or 30, as the case may be.

When the machine is threaded up, a "blanket" of staggered, parallel yarns 31 are, therefore, fed from the yarn source 31, respectively through opposed holes 55*a*, 56*a* (FIG. 3) in the uppermost yarn guides 55, 56 and then passed through appropriate holes in the next successive yarn guides, passing successively beneath the associated yarn feed roll 41, 40, 39 so that none of the yarns 31 normally engage any of the periphery of the yarn rolls 42, 41, 40 and 39. Thence, these yarns 31 pass through the yarn pullers 33, to the yarn jerkers (not shown) and thence through an additional guides to the needles 16, respectively. In the same manner, the yarns 21 are threaded through the pattern attachment 20 in the same fashion as described for pattern attachment 30.

At this stage, none of the yarn rolls 42, 43, 44, 45 engage any of the yarns 31; however, these yarns 31 are guided so that they pass outwardly adjacent to the bottom portion of all rolls 42, 43, 44, 45.

the rolls 42, 43, 44 and 45 are arranged adjacent to the bottom edges 34*b* of brackets 34 and 35*a* and in an arcuate array facing downwardly and away from the tufting machine 10 so that their peripheries are spaced from and adjacent to the yarns 31 and readily accessible by the operator. These rolls 42, 43, 44 and 45, of course, are parallel to each other and extend transversely across all yarns 31 throughout the transverse length the tufting machine.

Operations

When it is desired to cause certain of the yarns to be controlled by a prescribed roll, such as roll 42, the locking mechanisms 70 for the indexing plates 60 and 61 released so as to permit the manual rotation of these opposed pair of plates 60, 61. Thereafter, the alignment bar 73 is manually manipulated so as to simultaneously rotate the indexing plates 60, 61 such that the plate 61 is initially arranged in a zero position, as shown in FIG. 5. Thereafter, the rod 80 is removed from between the plates 60, 61 and passed between increment selected yarns 31 and the remaining yarns 31. When a group of such yarns 31 have been collected on yarn control rod 80, the rod is then replaced in its yarn receiving position, shown in FIG. 5, thereby withdrawing sidewise, and intermediate portion 31*a* from the remaining yarns 31 of the yarn blanket. In this zero position, none of yarns 31 contact the periphery of roll 42.

After rod 80 has been reinstalled between the plates 60 and 61, the rod 80*a* is temporarily removed from between the indexing plates 60, 61 and, thereafter, the plates 60, 61 are rotated through 90°. Thus, the locking mechanism 70 are pushed by the peripheries of the plates 60, 61 so that the plunger 70*b* are forced out of their original notches or recesses 72 and are spring urged into a subsequent pair of notches or recesses 72 when the plates 60, 61 reach the 90° position, shown for plate 61 in FIG. 6.

Figure 6:
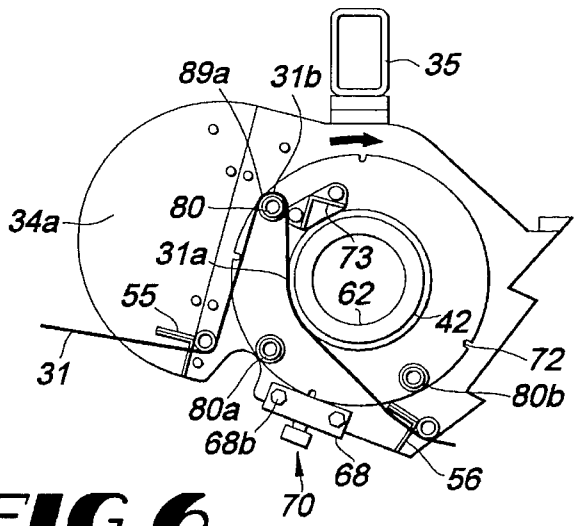
FIG. 6 is a view similar to FIG. 5 and showing the indexing assembly rotated 90°.
Figure 7:
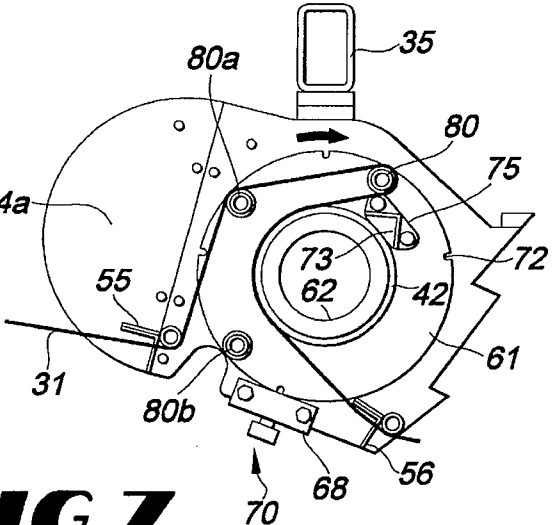
FIG. 7 is a view similar to FIGS. 5 and 6 and showing the indexing assembly rotated 180°.

It will be seen in FIG. 6 that the guide bar 80 forms bights 31*b* partially around rod 80 for urging the yarn increments 31*a* into engagement with only an initial short peripheral portion of the periphery of roll 42. The rod 80*a* is then replaced between the plates 60, 61 so as to be outwardly of increments 31*a*. Thereafter, the rod 80*b* is removed from between these plates 60, 61 and the plates 60, 61 are again manually rotated through 90° to its 180° position as shown in FIG. 7. Rod 80*b* is and then replaced to its original position, as shown in FIG. 7. Thus, the rod 80, in rotating bights 31*b*, from the 90° position of FIG. 8 to the 180° position of FIG. 7, carries the intermediate portions 31*a* of the yarn 31 progressively further around the periphery of the roll 42, so that they circumscribe about 160° of that periphery.

Figure 8:
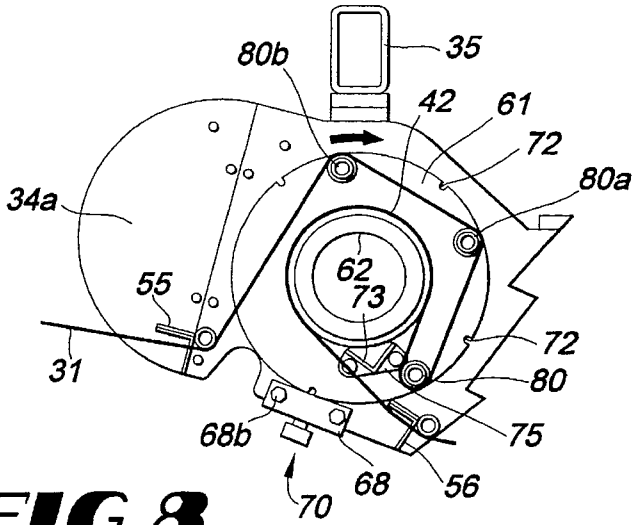
FIG. 8 is a view similar to FIGS. 5, 6, and 7 and showing the indexing assembly rotated 270°.

Thereafter, the plates 60, 61 are again rotated through 90° to the 270° position for plate 61, as shown in FIG. 8. FIG. 8 illustrates the operating position for the yarns 31, whereby the yarns 31 travel first over and partially around rod 80 and, thence, around approximately 270° of the outermost periphery of the roll 42. The yarns 31, which are to be controlled by the roll 42, are, therefore, deviated from their normal paths of travel from guide 55 to guide 56, whereby the upstream deviated portions of the yarn segments 31 pass initially around rod 80 and beneath rods 80*a* and 80*b* looping over less than the entire circumference of the roll 42 and then, under the control of roll 42, pass to the guide 56 and thence, along essentially parallel paths to the needles 16.

When the indexing plates, such as plate 61, are in the position shown in FIG. 8, the detents 70 are again tightened so as to lock the plates 60, 61 in a position rotated 270° from the original position shown in FIG. 5.

In like fashion, the additional rolls 43, 44 and 45 are provided with selected increments from different yarns 31 so that all of the yarns 31 of the yarn blanket contact one, and only one, of the rolls 42, 43, 44 and 45.

If it is desired to alter the feeding arrangement of the yarns 31 with respect to rolls 42. 43, 44 and 45, the appropriate opposed pairs of indexing plates 60, 61 are rotated back to their original zero positions as shown for plate 61, in FIG. 5 removing rods 80*b*, 80*a* and 80, when appropriate. Thereafter, different yarn segments or increments, such as increments 31*a*, can be removed from the yarn blanket and applied to a selected roll, without rethreading of the needles 16, thus reducing to a minimum, the change over to another pattern. Also, by cutting selected yarns 31 and exchanging ends which are then tied, different colored yarns can be fed to different needles 16.

It will obvious to those skilled in the an that many variations may be made in the embodiments herein chosen for the purpose of illustrating the present invention, without departing from the scope thereof as defined by the appended claims.

We claim:

1. A yarn feed mechanism for feeding yarns to the needles of a tufting machine comprising:

(a) a frame assembly having yarns passing adjacent thereto;

(b) a yarn feed roll mounted for rotation on said frame assembly, said roll having an axis about which said roll is rotated and a yarn driving periphery;

(c) a movable yarn applying member carried by said frame and disposed adjacent to said roll, and means for moving said yarn applying member with respect to said roll from yarn receiving position in which intermediate portions of said yarns are received by said yarn applying member,to a yarn applying position in which said yarn applying member applies increments of said yarns against portions of said periphery of said roll sufficiently that the rotation of said roll drives said yarns toward said needle;

(d) said yarn applying member including a yarn control rod and rod support on said frame for supporting said rod in a position spaced from and about parallel to the axis of said roll, said yarns being looped partially around said rod and said rod being positionable for holding a portion of said yarns against only a part of said periphery;

(e) said support including a pair of opposed plates removable supporting said rod therebetween;

(f) said plates being concentrically mounted with respect to said roll for independant rotation with respect thereto and said rod being supported in spaced relationship to said roll for orbital movement with respect to said roll.

2. The yarn feed mechanism defined in claim 2 wherein said yarn applying member is a rod supported for orbital movement about said roll for carrying said yarns into and out of engagement with a portion of said periphery of said roll.

3. The yarn feed mechanism defined in claim 1 including a yarn supporting rod movable with said yarn applying rod for holding increments of yarns, passing between said yarn supporting rod, away from engagement with said periphery of said roll.

4. The yarn feed mechanism defined in claim 3 wherein said yarn applying rod and said yarn support rod are disposed in spaced parallel relationship to each other, said rods being simultaneously movable in orbital paths about said roll.

5. The yarn feed mechanism defined in claim 4 including a second yarn supporting rod disposed parallel to said yarn applying rod and to the first mentioned yarn support rod, said second yarn support rod and said first mentioned yarn support rod cooperating with each other for supporting increments of said yarns out of engagement when said yarn applying rod, as said yarn applying rod applies other increments of said yarns to said periphery of said roll.

6. The yarn feed mechanism defined in claim 5 wherein said yarn applying rod and said first mentioned yarn supporting rod and said second yarn supporting rod are disposed in circumferentially spaced relationship, and including a pair of opposed rod supporting plates carried by said frame and supporting said yarn applying rod and said first mentioned yarn supporting rod and said second yarn supporting rod, in respective supported positions, by their ends, and means for releasably retaining said rods in their respective supported positions with respect to said plates.

7. A process of feeding yarns threaded to the needles of a tufting machine, comprising:

(a) diverting a plurality of first and second yarns along prescribed adjacent paths to said needles;

(b) disposing a first rotatable yarn roll transversely to said adjacent paths so that the periphery of said roll is adjacent to and spaced from said paths of said first and second yarns;

(c) diverting first intermediate portions of said first yarns from their paths and into engagement with a radial portion of the periphery of said roll;

(d) rotating said roll according to a prescribed pattern for simultaneously advancing said first yarns toward said needles in accordance with the rotation of said roll; and (e) wherein the step of diverting first intermediate portions includes passing a rod between intermediate portions of said first yarns and said second yarns, and moving said intermediate portions of said first yarns away from said second yarns and toward said periphery of said roll.

8. An apparatus for feeding yarn, comprising:

a feed roller having an outer surface for frictionally engaging said yarn;

means for rotating said feed roller about a longitudinal axis of said feed roller;

means for directing said yarn along one side of said feed roller;

first and second plates located on opposite ends of said feed roller, and means for rotating about said longitudinal axis;

at least one control rod parallel to said feed roller and releasably engaged between said first and second plates;

said one control rod for placing said yarn between said one control rod and said feed roller and for directing said yarn into engagement with said feed roller upon rotation of said first and second plates wherein said yarn is fed along said one side of said feed roller upon rotation of said feed roller.

9. The yarn feeding apparatus as set forth in claim 8, further comprising a second control rod releasably engaged between said first and second plates, said second control rod for directing said yarn to said one control rod so that said yarn does not contact said feed roller upon travel from said second control rod to said one control rod.

10. The yarn feeding apparatus as set forth in claim 8, further comprising means for locking said first and second plates at any one of a plurality of angles of rotation about said longitudinal axis.

11. The yarn feeding apparatus as set forth in claim 8, further comprising an alignment bar connected between said first and second plates for causing said first and second plates to rotate in synchronism.

12. A method for feeding yarn, comprising the steps of:

directing said yarn along one side of a feed roller, said feed roller having an outer surface for frictionally engaging said yarn and having first and second plates on opposite ends of said feed roller;

positioning a control rod parallel to said feed roller between said first and second plates with said yarn being placed between said control rod and said feed roller;

rotating said first and second plates about a longitudinal axis of said feed roller so that said yarn is directed around said control rod and into engagement with said feed roller; and rotating said feed roller to feed said yarn along said one side of said feed roller.

13. The method for feeding yarn as set forth in claim 13, further comprising the step of positioning a second control rod parallel to said feed roller between said first and second plates with said second control rod being placed between said yarn and said feed roller wherein said yarn travels from said second control rod to said control rod without contacting said feed roller.

14. The method for feeding yarn as set forth in claim 13, further comprising the step of positioning a third control rod parallel to said feed roller between said first and second plates with said third control rod being placed between said yarn and said feed roller.

15. The method for feeding yarn as set forth in claim 14, wherein said steps of positioning said control rod, said second control rod, and said third control rod comprise the steps of positioning said control rod, said second control rod, and said third control rod so that said yarn travels from said third control rod, to said second control rod, and to said control rod without contacting said feed roller and so that said yarn is in contact with said feed roller for at least half a rotation of said feed roller.

16. The method for feeding yarn as set forth in claim 14, wherein said steps of positioning said control rod, said second control rod, and said third control rod comprise the steps of positioning said control rod, said second control rod, and said third control rod so that said yarn travels from said third control rod, to said second control rod, and to said control rod without contacting said feed roller and so that said yarn is in contact with said feed roller for at least three-fourths of a rotation of said feed roller.

* * * * *

UNITED STATES PATENT AND TRADEMARK OFFICE

CERTIFICATE OF CORRECTION

PATENT NO. : 5,622,126

DATED : April 22, 1997

INVENTOR(S) : Roy T. Card and Wilton Hall

It is certified that error appears in the above-indentified patent and that said Letters Patent is hereby corrected as shown below:

Column 2, line 14, after "quick change yarn" change "teed" to -- feed --.

Column 4, line 18, after "The" delete ", the".

Column 4, line 19, after "drive" change "for" to -- four --.

Column 5, line 49, after "corresponding" change "socket" to -- sockets --.

Column 5, line 54, change "proximel" to -- proximal --.

Column 6, line 39, after "indexing plates 60 and 61" insert -- are --.

Column 7, line 44, after "those skilled in the" change "an" to -- art --.

Claim 1, line 11, after "roll from" at the beginning of the line, insert -- a --.

Claim 1, lines 25 and 26, change "removable" to -- removably --.

Claim 2, line 1, change "defined in claim 2" to -- defined in claim 1 --.

UNITED STATES PATENT AND TRADEMARK OFFICE

CERTIFICATE OF CORRECTION

PATENT NO. : 5,622,126

DATED : April 22, 1997

INVENTOR(S) : Roy T. Card and Wilton Hall

It is certified that error appears in the above-indentified patent and that said Letters Patent is hereby corrected as shown below:

Claim 8, line 9, after "means for rotating" insert -- said first and second plates --.

Claim 13, line 1 change "as set forth in claim 13" to -- as set forth in claim 12 --

Signed and Sealed this

Twenty-second Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO : 5,622,126

DATED : April 22, 1997

INVENTOR(S) : Roy T. Card and Wilton Hall

It is certified that error appears in the above-identified patent and that said Letters Patent are hereby corrected as shown below:

Column 5, line 15, after "each opposed" change "pairs" to -- pair --.

Column 5, line 44, after "extending across" insert -- the --.

Column 6, line 18, at the end of the line change "guides" to -- guide --.

Column 6, line 40, after "these opposed" change "pair" to -- pairs --.

Column 7, line 4, after "Rod 80b is" delete "and".

Column 7, line 44, after "It will" at the beginning of the line, insert -- be --.

Claim 5, line 6, after "yarns out of engagement" change "when" to -- with --.

Signed and Sealed this

Twelfth Day of August, 1997

Bruce Lehman

*Attest:*

BRUCE LEHMAN

*Attesting Officer*

*Commissioner of Patents and Trademarks*